United States Patent [19]

Boon

[11] Patent Number: 4,621,741

[45] Date of Patent: Nov. 11, 1986

[54] READILY DISASSEMBLEABLE PORTABLE ROOF HOIST MOUNTED ON THE ROOF OF A BUILDING FOR LIFTING HEAVY PRODUCTS TO THE ROOF FROM BELOW

[76] Inventor: Charles W. Boon, 515 33rd St., Fort Madison, Iowa 52627

[21] Appl. No.: 812,382

[22] Filed: Dec. 23, 1985

[51] Int. Cl.[4] ..... B66C 23/26

[52] U.S. Cl. ..... 212/175; 212/261; 212/265

[58] Field of Search ..... 212/175, 178, 195, 232, 212/238, 244, 254, 255, 258, 261, 265; 414/680, 729; 254/266; 182/120

[56] References Cited

U.S. PATENT DOCUMENTS

| | | | |
|---|---|---|---|
| 398,114 | 2/1889 | Barkelew | 212/255 |
| 2,149,381 | 3/1939 | Young | 212/256 |
| 2,581,087 | 1/1952 | Eakin | 212/261 |
| 2,710,102 | 6/1955 | Knutson | 212/244 |
| 2,772,789 | 12/1956 | Hussong et al. | 212/261 |
| 2,786,581 | 3/1957 | Balogh | 212/186 |
| 3,043,443 | 7/1962 | Han | 212/186 |
| 3,111,225 | 11/1963 | Miller et al. | 212/261 |
| 3,576,267 | 4/1971 | Blevins | 414/680 |
| 4,135,627 | 1/1979 | McInerney | 212/195 |
| 4,578,016 | 3/1986 | Richardson | 414/680 |

FOREIGN PATENT DOCUMENTS

| | | | |
|---|---|---|---|
| 4530 | of 1879 | United Kingdom | 212/265 |

*Primary Examiner*—Trygve M. Blix
*Assistant Examiner*—Stephen P. Avila
*Attorney, Agent, or Firm*—Learman & McCulloch

[57] ABSTRACT

A portable, readily disassembleable, roof hoist mounted on the roof of a building for lifting heavy products, such as heavy rolls of roofing to the roof wherein a first, base, A-frame is disposed transversely to the edge of the roof with the ends of its legs adjacent an edge of the roof, and lies with its apex rearward on the roof, free of any securement to the roof. A second, generally vertically disposed A-frame has its leg ends releasably pivotally connected to the leg ends of the first A-frame for fore and aft vertical swinging movement of its apex from a position above a location spaced substantially inboard of the edge of the roof to a position substantially outboard of the edge of the roof. An elongate forwardly extending hydraulic cylinder has a cylinder rod pivotally releasably connected to the apex of the second A-frame, and its opposite end is pivotally releasably connected at the apex of the first A-frame. A winch drum driven by a hydraulic motor is mounted at the apex of the first frame and has a cable extending around a sheave at the apex of the second A-frame to support a load and a hydraulic pump and internal combustion engine assembly is detachably connected to weight down the base A-frame and is hydraulically coupled with the cylinder and motor to drive them selectively.

7 Claims, 7 Drawing Figures

READILY DISASSEMBLEABLE PORTABLE ROOF HOIST MOUNTED ON THE ROOF OF A BUILDING FOR LIFTING HEAVY PRODUCTS TO THE ROOF FROM BELOW

BACKGROUND OF THE INVENTION

This invention relates to a roof hoist mounted on the roof of a building for lifting products, such as heavy rolls of roofing material, from the ground to the roof, and more particularly to a readily disassembleable roof hoist, which, in disassembled form, can be readily transported up a ladder or the like to the roof, and then very rapidly assembled and placed in operation.

While prior hoists have been proposed for various purposes, as indicated by the below listed patents, none of the patents listed were directed to solving the problems solved by the present invention, and none of the structures disclosed in the patents listed have, to my knowledge, been, for various reasons, deemed capable of filling the need which exists for a readily demountable, and assembleable, light-weight portable roof hoist, which in normal use, need not be bolted to the roof on which it is supported.

| | | | |
|---|---|---|---|
| 398,114 | Barkelew | 2,786,581 | Balogh |
| 2,149,381 | Young | 3,043,443 | Hall |
| 2,581,087 | Eakin | 3,111,225 | Miller et al |

SUMMARY OF THE INVENTION

The present invention contemplates a first base A-frame which is disposed transversely to the edge of the roof, with the ends of its legs adjacent an edge of the roof, and its apex considerably rearwardly of the edge of the roof, lying on the roof, free of any securement to the roof. A second, generally vertically disposed and vertically swingable A-frame has its leg ends releasably pivotally connected to the leg ends of the base A-frame, and an elongate forwardly extending hydraulic cylinder, releasably connected at the apex of the first A-frame has its cylinder rod pivotally releasably connected to the apex of the second A-frame, for swinging the second A-frame fore and aft from a position in which its apex is inboard of the edge of the roof to a position in which its apex is outboard of the edge of the roof. A sheave is supported for rotation at the apex of the second frame, and a winch drum is mounted at the apex of the base frame and, has a cable, wound around the drum, which extends around the sheave and supports a load-carrier such as a sling on its front end. A hydraulic pump and internal combustion engine assembly, detachably connected to weight down the apex end of the base A-frame, is hydraulically coupled with the cylinder, and with a hydraulic motor driving the winch drum.

One of the prime objects of the present invention is to provide a roof hoist, capable of lifting rolls of roofing, which may weigh in the neighborhood of 400 pounds, from the ground to the roof of a building, without any need for anchoring or ballasting the hoist. It should be understood, however, that the roof hoist is capable of lifting much heavier loads, in the neighborhood of 1000 pounds, via the expedient of simply ballasting the apex end of the base A-frame.

Another object of the invention is to provide a hoist which can be simply supported on a roof in a manner to achieve a considerable mechanical advantage, without any need for penetrating the roof to hold the hoist in position, the hoist being capable of operation to deposit heavy roofing rolls and the like in a position of use.

Still another object of the invention is to provide a very light-weight hoist of the character described which can be easily carried up a ladder in disassembled condition, and then quickly assembled in operative position on the roof.

A still further object of the invention is to provide a very compact and structurally efficient roof hoist which, at its rear end, has side-by-side beams extending from the apex of its base A-frame to provide a structure in which the winch drum mount, and the pump and internal combustion engine mount, can function to clamp the beams of the base A-frame in assembled condition.

A still further object of the invention is to provide a roof hoist of light-weight construction which is both durable and reliable, and can be operated by workmen who are not technically skilled.

Other objects and advantages of the invention will become apparent by reference to the following specification and to the drawings.

IN THE DRAWINGS

Figure 1:
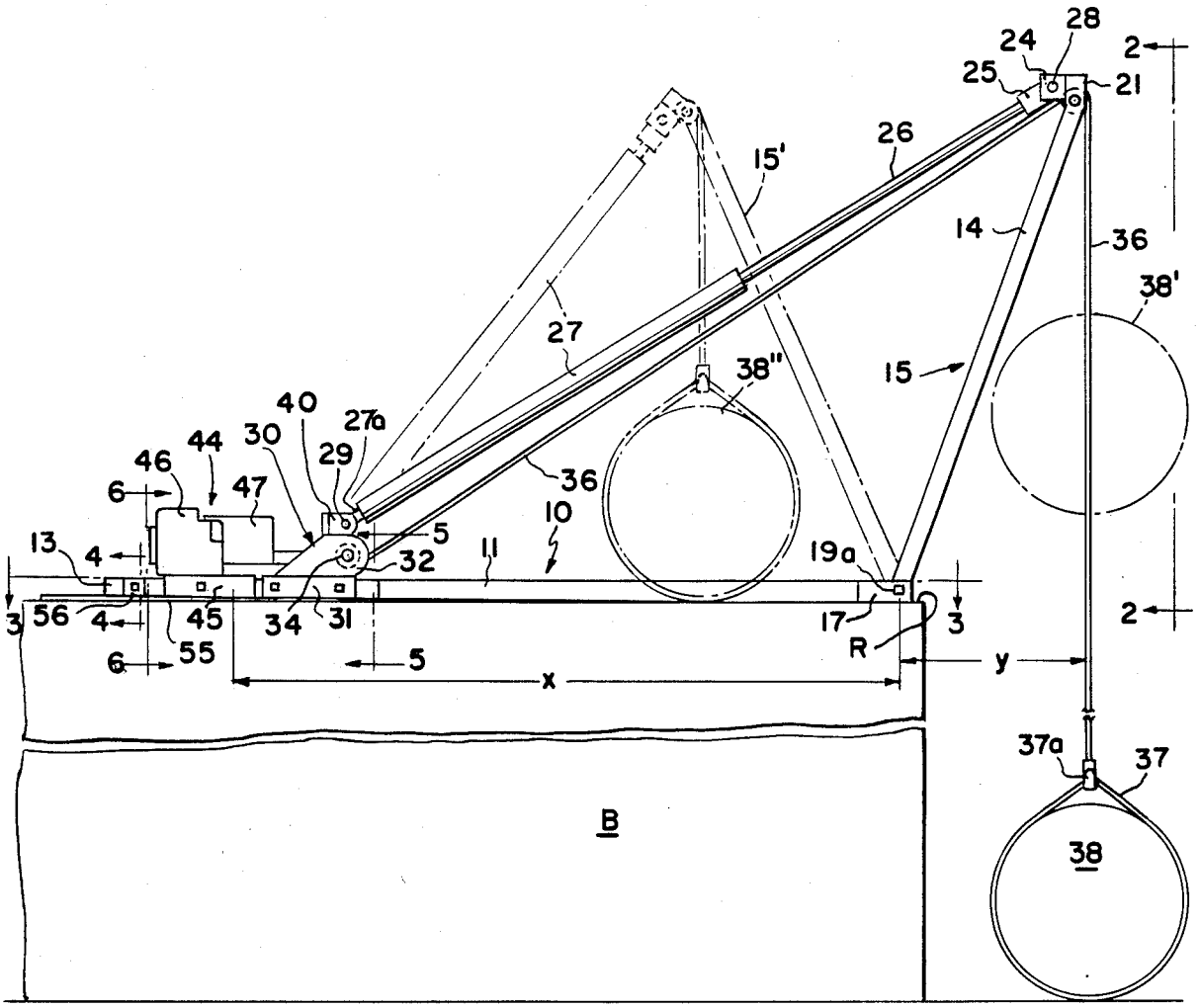
FIG. 1 is a side elevational view, showing the hoist in position on the roof of a building, and in the act of lifting a roll of roofing, the chain lines showing, and then an intermediate position of the roofing roll, the A-frame depositing the roll on the roof of the building.
Figure 2:
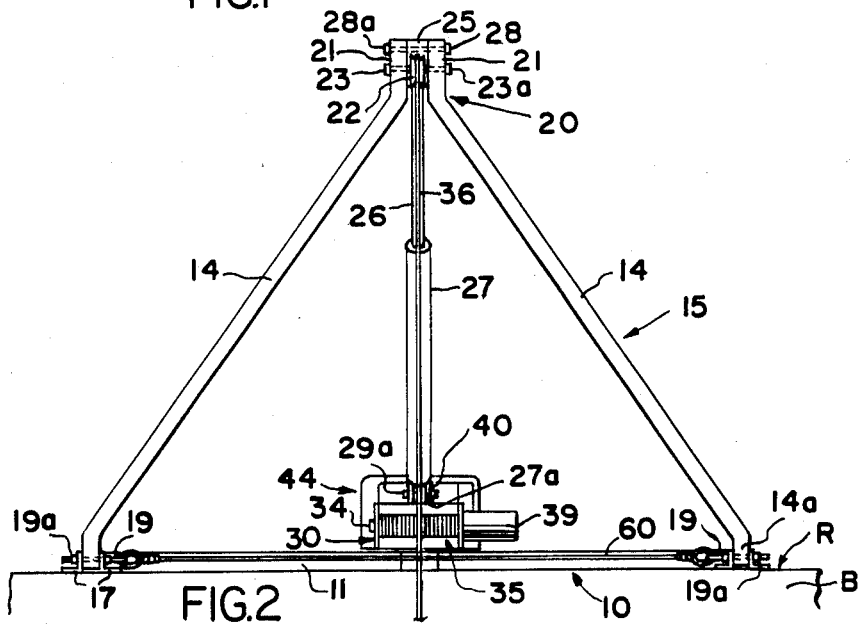
FIG. 2 is a fragmentary, front elevational view, taken on the line 2—2 of FIG. 1.
Figure 3:
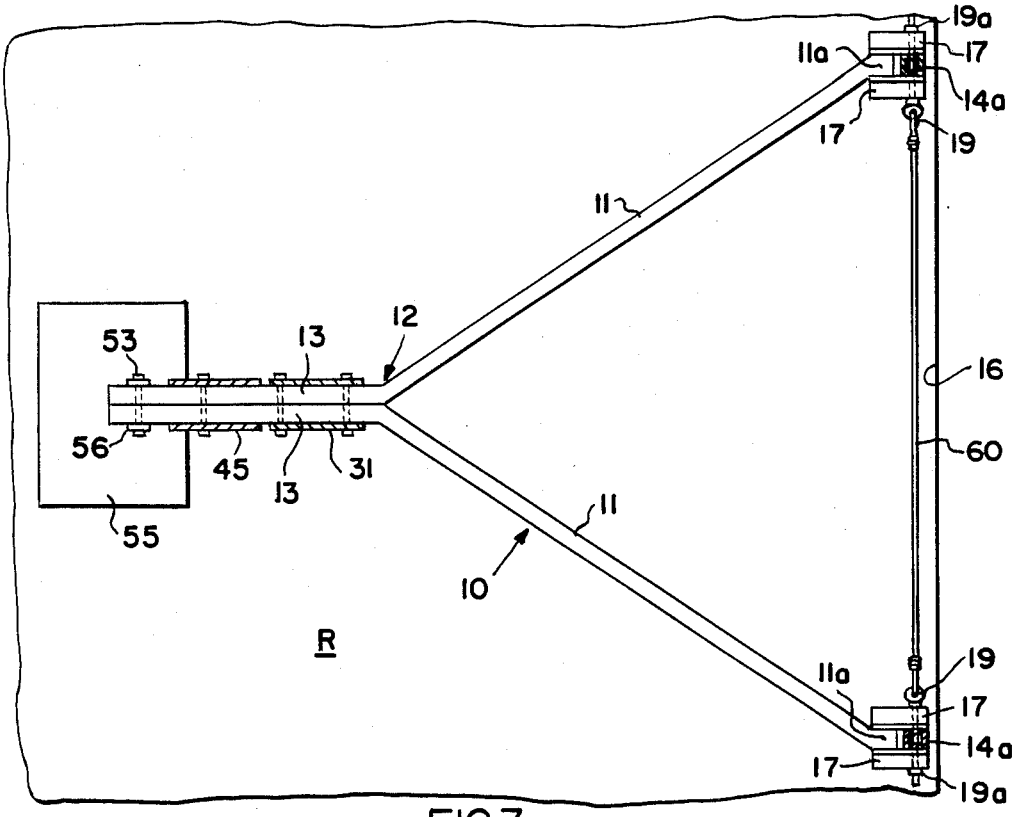
FIG. 3 is a sectional plan view taken on the line 3—3 of FIG. 1.
Figure 4:
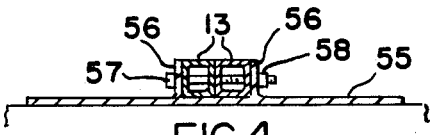
FIG. 4 is an enlarged, sectional, transverse elevational view, taken on the line 4—4 of FIG. 1.

Referring now more particularly to the accompany drawings, and in the first instance to FIGS. 1-3 thereof, my roof hoist comprises a base A-frame, generally designated 10, which is constituted of divergent legs 11, joined at an apex portion 12, and having rearwardly extending projections or beams 13 lying in side-by-side, abutting relation. The front ends of legs 11 have portions 11*a*, which extend angularly so that they may be readily, releasably pivotally joined to the legs 14 of a second A-frame, generally designated 14. It is to be understood that the base A-frame 10 is disposed transversely to the edge 16 of the roof surface R of the building B, which is only schematically illustrated in FIG. 1, and lies flatwise thereon with its leg ends 11*a* lying in a plane which generally parallels the edge 16 of the roof.

Fixed to opposite sides of the leg ends 11*a* are angle plates 17, which function to provide a clevis at the end of each leg 11 to accommodate the lower ends of the legs 14 of A-frame 15 which have openings 18 for freely passing the unthreaded pin portion of bolts 19 secured by nuts 19*a*. Openings 20 are provided in the mount plates 17 to pass the bolts 19. The base A-frame 15 will thus be vertically swingable from the position in which it is shown in solid lines in FIG. 1, to the position at 15' in which it is shown in chain lines, and, when desired, can be readily decoupled from the base frame 10.

As will appear, the legs 11 of base A-frame 10 and 14 of the second A-frame 15 are both formed of tubular members so as to be relatively light in weight. The inturned lower ends 14*a* of legs 14 facilitate the pivotal attachment of the legs 14 to the legs 11. At their upper apex end 20, the legs 14 are provided with parallel projections 21 (FIG. 2) which revolvably support a sheave 22. The sheave 22 is revolvably supported in position by the unthreaded pin portion of a bolt 23, which is secured by a nut 23*a*, the bolt 23 also serving to connect the ends 21. Also provided on the upwardly extending projections 21 are a pair of ears 24, to form a clevis for pivotally receiving an attachment plate 25, fixed to the piston rod 26 of a hydraulic cylinder 27. The end 25 of piston rod 26 is detachably connected to the apex of the A-frame 15 by the unthreaded pin portion of a bolt 28 which is secured by a nut 28*a* and also serves to fix the ends 21 together.

Figure 5:
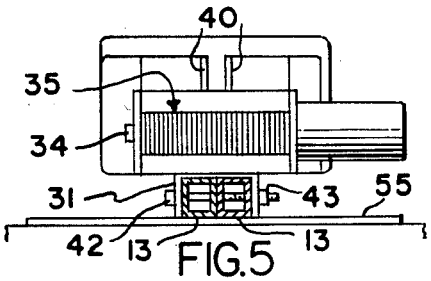
FIG. 5 is an enlarged, sectional, transverse elevational view, taken on the line 5—5 of FIG. 1.

At its opposite end, cylinder 27 is detachably pivotally connected as at 29, to a weldment, generally designated 30, which is perhaps best illustrated in FIG. 5. Weldment 30 includes a saddle 31 which fits over and embraces the side-by-side beam projections 13. It further includes a pair of forwardly projecting ears 32, extending from a plate 33 fixed to saddle 31. The ears 32, journal a shaft 34, on which a winch drum 35 is mounted. A winch cable 36, having its rear end wound on and secured to drum 35, has a load supporting hook end 37*a* which passes over the sheave 22, and may be provided with a releasable sling 37 for the purpose of embracing an elongate roofing roll 38, which may weigh in the neighborhood of 400 pounds. A hydraulic motor 39 is mounted on one of the ears 32, and has its output shaft connected to the drum shaft 34, to drive it selectively in one direction of rotation or the other.

Fixed to the weldment 30 are the ears 40, which form a clevis for accommodating the lower mount end plate 27*a* of cylinder 27, the pin 29, comprising the unthreaded portion of a bolt secured by nut 29*a* to releasably secure it in position. Thus, the weldment 35 provides a triple function in providing a mount for the lower end of hydraulic cylinder 27 at the apex end of base frame 10, in serving as a base for winch drum 35 and hydraulic motor 39, and still further in embracing the beam projections 13 and functioning to secure them in juxtaposed position. As FIG. 5 indicates, bolts 42, secured by nuts 43 extend through suitable openings in saddle 31, and in the members 13, to not only clamp the saddle 31 in position, but also to clamp the beam projections 13 in assembled position.

Figure 6:
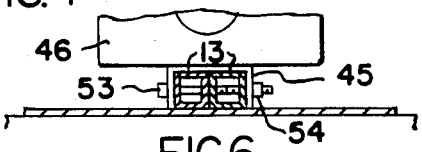
FIG. 6 is an enlarged, sectional, transverse elevational view, taken on the line 6—6 of FIG. 1.

Discretely mounted rearwardly of the weldment 30, is a hydraulic pump and internal combustion engine assembly, generally designated 44, which, as FIG. 6 indicates, also includes a fixed saddle 45, for the purpose of mounting on, and securing, the beam projections 13 in assembled relation. The engine 46, may be a conventional, gasoline powered engine, connected to power a hydraulic pump 47 of conventional design having controls 47*a* and 47*b*, which is used to supply hydraulic fluid to the hydraulic motor 39, and to hydraulic cylinder 27.

Figure 7:
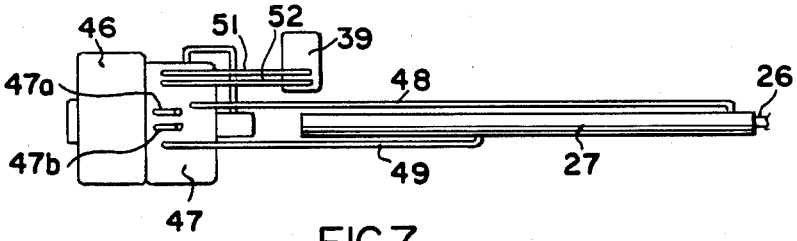
FIG. 7 is a schematic diagram illustrating the hydraulic connections.

FIG. 7 schematically indicates the hydraulic line connections to opposite ends of the cylinder 27 at 48 and 49, and further schematically illustrates the hydraulic connections to pump 39 at 50 and 51.

As FIG. 6 clearly indicates, the assembly 44 also is responsible for helping to secure the beam projections 30 in position, via a bolt 53, secured by a nut 54.

Provided attached to the rear end of beam projections 13, is a ballast plate 55 on which a man can stand, to provide additional ballast, if that should be deemed necessary. Plate 55 includes upstanding ears 56, which embrace the beam projections 13, and also functions to join the beam ends via the bolt 57, which extends through suitable openings in ears 56 and beams 13, and is secured by nut 58.

At the front end of the base frame 10, eye bolts 59 detachably connect to angles 17, as shown in FIGS. 2 and 3. A cable 60 couples to each of the eye bolts 59, to prevent any spread of legs 11 under the applied load.

THE OPERATION

Assuming that the hoist is in the position shown in FIG. 1, with a sling 37 accommodating the heavy roofing roll 38, being secured by cable hook end 37*a*, and engine 46 is operating, it is merely necessary for the operator to position pump control 47*a* such that power is supplied to hydraulic motor 39, to rotate drum 35 in a rewind direction, to rewind cable 36 on the drum such as to lift the roofing roll 38 to the 38' position shown in FIG. 1, in which it vertically clears the roof R. Then, the operator positions pump control 47*b* such as to supply hydraulic fluid to the cylinder 27 in a manner to retract cylinder 26, and swing the roll 38 to a position above the position in which it is shown at 38" in FIG. 1. By then positioning winch drum control 47*a* differently, the pump 44 supplies hydraulic fluid to the hydraulic motor 39, such that drum 35 is revolved in an opposite direction and lowers the roll 38 to the 38" position.

In normal use, the weight of the component parts 30, 44 and 46 is sufficient, operating through moment arm x, to overcome the weight of roll 38, operating through moment arm y, with a considerable safety factor, without any need for ballasting the plate 55. This is the case even though the total weight of the assembled roof hoist is less than 300 pounds. The engine and pump assembly 44, for example, weighs approximately 65 pounds, and the winch and pump assembly 30 weights approximately 40 pounds. Both, consequently can be carried up a ladder by one man.

It is important that the roof hoist be readily transportable in disassembled condition by a workman climbing a ladder, and then readily reassembled on top of the roof. With the construction which has been disclosed, this is readily accomplished because assembly and disassembly is so easy, and no one part weighs so much that it cannot be transported up a ladder.

While one embodiment of the invention has been described in detail, it will be apparent to those skilled in the art that the disclosed embodiment may be modified. Therefore, the foregoing description in all aspects is to be considered exemplary rather than limiting in any way, and the true scope of the invention is that defined in the following claims.

What is claimed is:

1. In an improved portable, readily disassemblable, roof hoist mounted on the roof of a building for lifting heavy products, such as heavy rolls of roofing, from the ground, or from below, to the roof, the combination of:

a. a first, base, A-frame, disposed transversely to the edge of the roof with the ends of its legs adjacent an edge of the roof, and lying with its apex rearward thereof, on the roof, free of an securement to the roof; a plane through the ends of the legs lying generally parallel to the edge of the roof;

b. a second generally vertically disposed A-frame having its leg ends releasably pivotally connected to the leg ends of the first A-frame for fore and aft vertical swinging movement of its apex from a position above a location spaced substantially inboard of the edge of the roof to a position substantially outboard of the edge of the roof;

c. an elongate forwardly extending hydraulic cylinder having a cylinder rod pivotally releasably connected to the apex of the second A-frame, and its opposite end pivotally releasably connected at the said apex of the first A-frame;

d. a sheave supported for rotation at the apex of the second frame;

e. a winch drum mounted at the apex of the first frame and having a cable wound around the drum with a free end extending around the sheave and having a load carrier mounted on the forward end thereof;

f. a hydraulic motor connected to drive said winch drum; and g. a hydraulic pump and internal combustion engine assembly detachably connected to weight down said first A-frame and hydraulically coupled with said cylinder and motor to drive them selectively.

2. The further improved invention defined in claim 1 wherein the legs of said A-frame each have projections extending in parallel side-by-side disposition rearwardly beyond the apex of said A-frame, and said legs of the A-frame are connected together by releasable securing means clamping said projections.

3. The further improved invention of claim 2 wherein a support frame mounts said winch and hydraulic motor and has a saddle member embracing said projections adjacent said apex, and said securing means also releasably fixes said winch and motor in operative position.

4. The further improved invention of claim 3 wherein said support frame also mounts the lower end of the hydraulic cylinder.

5. The further improved invention of claim 3 wherein the hydraulic pump and internal combustion engine assembly are mounted on a second discrete U-shaped saddle member which embraces said projections rearward of the said support frame, and said securing means also releasably fixes said pump and engine assembly in operative position.

6. The further improved invention of claim 5 wherein a ballast supporting base plate fixes to the rear of said projections.

7. The further improved invention of claim 6 wherein cable means releasably connects the legs of said first A-frame.

* * * * *